United States Patent [19]

Henn

[11] 4,373,715

[45] Feb. 15, 1983

[54] RIDING ANIMAL DEVICE FOR CHILDREN

[76] Inventor: Billie R. Henn, Box 546, Havre, Mont. 59501

[21] Appl. No.: 249,817

[22] Filed: Apr. 1, 1981

[51] Int. Cl.[3] ..... A63G 19/00

[52] U.S. Cl. ..... 272/1 R; 4/476; 272/52.5; 272/53.2; 272/1 D

[58] Field of Search ..... 272/1 R, 1 B, 1 C, 1 D, 272/52, 52.5, 53.1, 53.2; 297/181; 280/1.13, 1.22; 46/108, 123, 127, 223, 124, 163, 164; 4/476, 478; D23/53; 40/117, 118, 119, 120

[56] References Cited

U.S. PATENT DOCUMENTS

| | | | |
|---|---|---|---|
| D. 125,770 | 3/1941 | Jockwig et al. | D23/53 |
| D. 142,909 | 11/1945 | Schnittmann | D23/53 |
| D. 185,766 | 7/1959 | Manushkin | D23/53 |
| 1,173,150 | 2/1916 | Hubbard | 46/124 X |
| 1,272,395 | 7/1918 | Dewey | 297/181 X |
| 1,346,953 | 7/1920 | Gould | 46/163 |
| 1,851,768 | 3/1932 | Hubbell | 272/1 B |
| 2,552,002 | 5/1951 | Dunbar | 272/53.1 |
| 2,712,937 | 7/1955 | Bell | 272/53.1 |
| 3,199,867 | 8/1965 | Pembridge | 272/1 D |
| 3,277,602 | 10/1966 | Speers et al. | 46/163 X |
| 3,412,998 | 11/1968 | Lott et al. | 272/1 R |
| 3,952,449 | 4/1976 | Terzian | 46/123 X |
| 4,037,833 | 7/1977 | Anderson | 272/52 |
| 4,120,493 | 10/1978 | Sommer | 272/52 |
| 4,174,544 | 11/1979 | Furusawa | 4/476 X |
| 4,242,830 | 1/1981 | Hauser | 46/163 X |

*Primary Examiner*—Richard T. Stouffer

*Attorney, Agent, or Firm*—Mallinckrodt & Mallinckrodt

[57] ABSTRACT

A riding animal device for children in which the identity of the animal can be changed from time to time by removal of head and tail portions and replacement with alternate head and tail portions representing a different animal. The body portion may be recessed and equipped with a removable receptacle part in the form of a saddle having an opening from which depends a catch receptacle for use as a chamber pot to catch and retain body wastes excreted by a child undergoing toilet training, or for use as a container for flowers, plants, or the like if it is desired that the animal device be used for decoration or display purposes. The head is preferably mounted for up and down oscillation by means of a bridle and reins attached thereto.

4 Claims, 6 Drawing Figures

RIDING ANIMAL DEVICE FOR CHILDREN

BACKGROUND OF THE INVENTION

1. Field

The invention is in the field of animal-simulating devices adapted for seating a child in a riding posture for various purposes.

2. State of the Art

Animal likenesses of size and character adapted to seat a child for riding purposes have long been produced as toys for children. In at least one instance, namely U.S. Pat. No. 2,552,002 of May 8, 1951, such an animal likeness in the form of a horse provided with a simulated saddle has included a chamber pot, so that a parent can employ the device for toilet training a child. However, no instances of such an animal likeness, for whatever use, is known to be capable of transformation into a different animal selected from a plurality of possible choices.

3. Objective

It was a principal objective in the making of the invention to provide an animal device for various uses wherein the kind of animal depicted can be quickly and easily changed to a selected one of a plurality of possibilities.

SUMMARY OF THE INVENTION

In accomplishing the aforestated objective of the invention, a principal feature is the provision of a body portion that can be employed together with different head and tail parts to represent a number of different animals to be "ridden" by a child in accordance with his preference from time to time. The body part is provided at its forward end with means for removably attaching different head parts, and at its rear end with means for removably attaching different tail parts correlated with particular head parts chosen from time to time.

The attaching means employed at the opposite ends of the body part are preferably narrow slots into which tongue portions of the respective head and tail parts are fitted for temporary attachment to the body part.

Depending upon the use to which it may be desired that the device be put, the body part may or may not be provided with a simulated saddle part and may or may not be provided with an upwardly-open recess into which a receptacle may be placed. The receptacle, if used, may be formed as a depending portion of the saddle part, which is arranged to be removably placed on the back of the body part, with the receptacle accommodated by the recess and serving, if desired, as a chamber pot for toilet training of children. The head part may be provided with a bridle and reins for grasping by a child seated on the animal.

The head-attaching slot may be provided with backward clearance for oscillation of the head part backwardly and forwardly by manipulation of the reins.

THE DRAWINGS

An embodiment representing the best mode presently contemplated by carrying out the invention is illustrated in the accompanying drawings, in which:

FIG. 1 is a pictorial view of the device of the invention in a form intended for use as toilet training for children, the head and tail parts being those of a horse or pony;

FIG. 2, a view similar to that of FIG. 1 but looking from the rear end, with chamber pot saddle removed;

FIG. 3, an exploded view showing the device of FIGS. 1 and 2 from a different vantage point and with alternative head parts and tail parts available for replacing those of FIGS. 1 and 2;

FIG. 4, a longitudinal vertical section taken along the line 4—4 of FIG. 2, with head part and tail part removed;

FIG. 5, a transverse vertical section taken along the line 5—5 of FIG. 4; and FIG. 6, a longitudinal vertical section taken along the line 6—6 of FIG. 3.

DETAILED DESCRIPTION OF THE ILLUSTRATED EMBODIMENT

In the form illustrated, a body part 10 is provided with four legs, indicated 11 respectively, for firm support on a receiving surface such as the floor of a room in which the device is placed, and is preferably stylized to provide a pleasing representation of the body of a four-legged animal. Such body part 10 is provided at its forward end with a narrow slot 12, open forwardly and upwardly, closed at its lower end, and projecting deeply into the body part for receiving a rearwardly extending, flat tongue portion of a head part representative of the head of a particular animal suitable for use with the body part.

Figure 1:
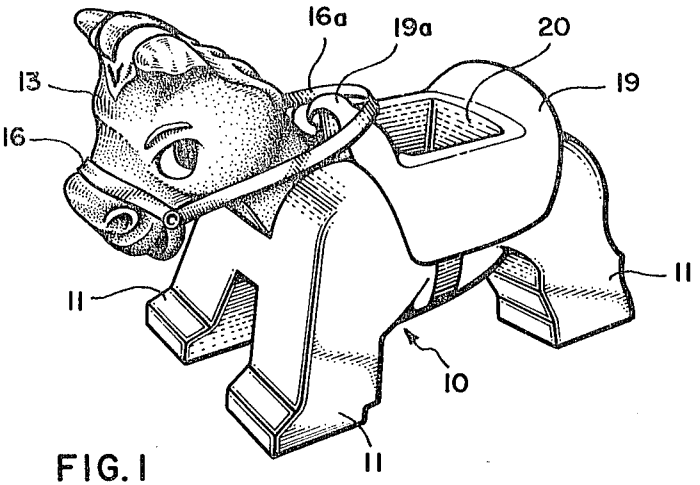
Figure 2:
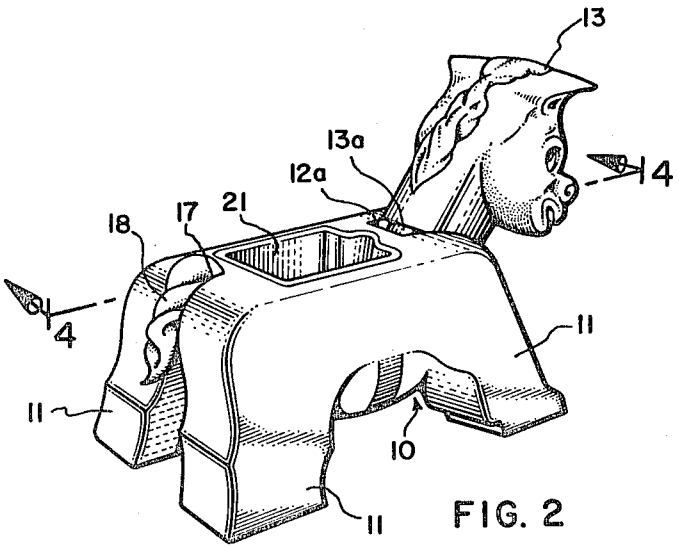

As illustrated in FIGS. 1 and 2, and head part 13 is the stylized head of a horse or pony. It is provided with a backwardly extending, flat tongue portion **13*a* similar to the flat tongue portions 14*a* and 15*a* of alternative head parts 14 and 15**, respectively.

Figure 4:
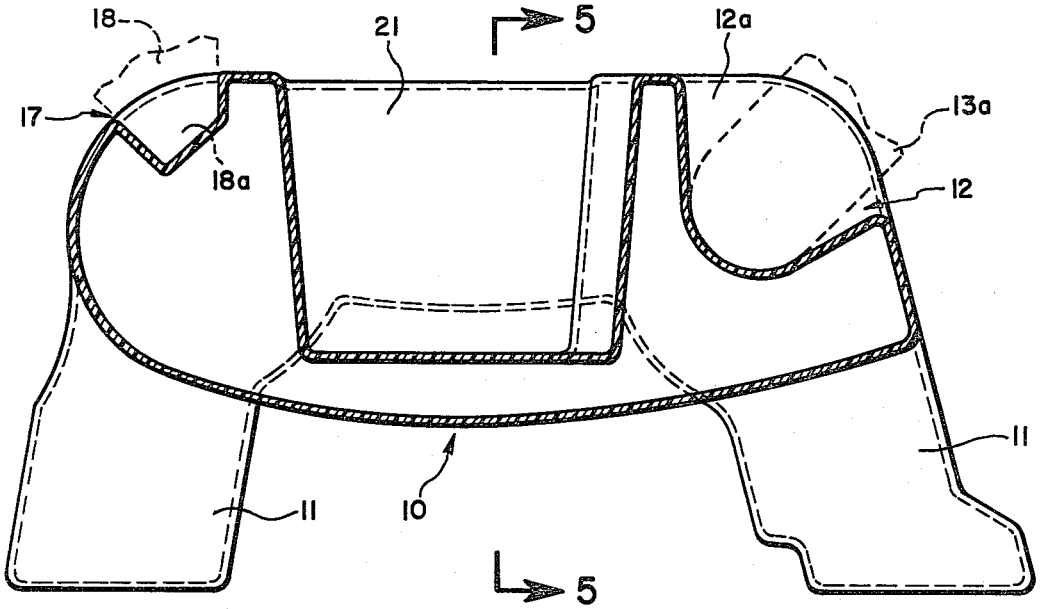
Figure 5:
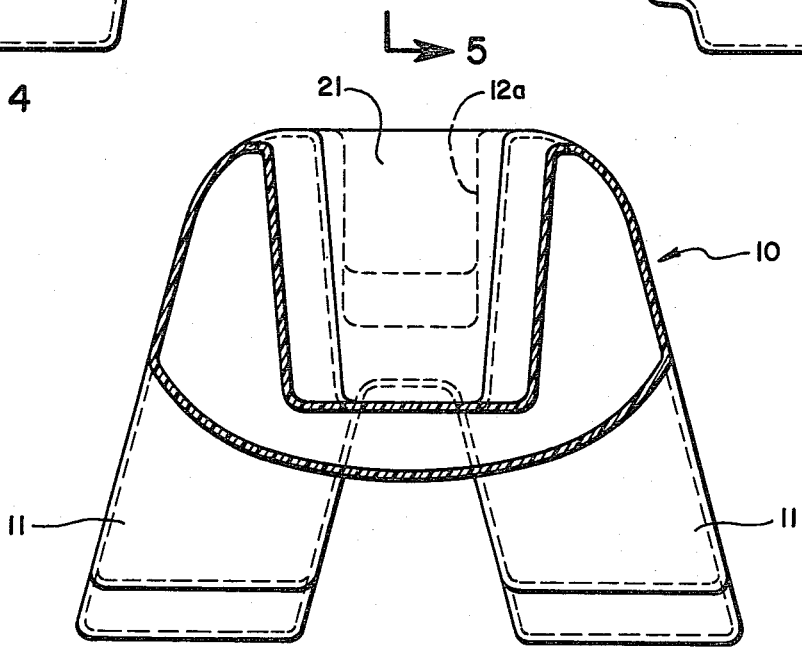
Figure 6:
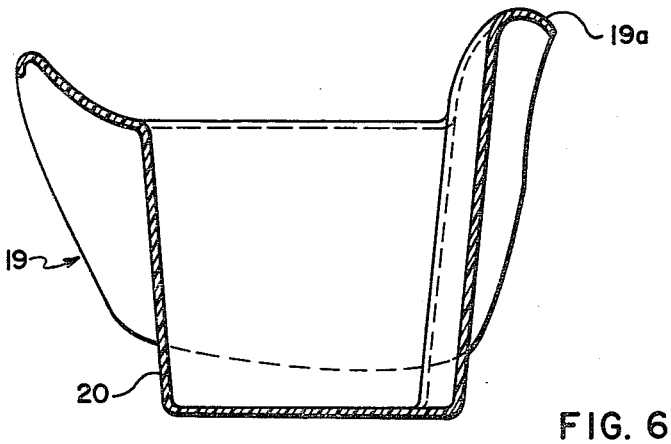

Slot 12 receives one or the other of the tongues **13*a*, 14*a* and 15*a*, as indicated by broken lines in FIG. 4, with the head part normally in a somewhat lowered position maintained by abuttment of the forward edge of the tongue portion against the closed lower end of the slot as a limit stop for gravity descent of the head part. The slot is of a length that will provide leeway (indicated by space 12*a*) upwardly and backwardly of the received head-part tongue 13*a* sufficient to permit oscillation of the head part backwardly and forwardly within the cradle that is, in effect, formed by the slot. So that a child seated on the device can oscillate the head part, such head part may be provided with a bridle 16 and reins 16*a***.

Body part 10 is provided at its rear end with a narrow slot 17 adapted to snugly receive the forwardly extending, flat tongue portion of a selected one of a plurality of possible tail parts corresponding in character to the respective head parts. In the embodiment of FIGS. 1 and 2, tail part 18 simulates the tail of a horse or pony in stylized manner. It has a forwardly extending flat tongue portion **18*a* (see the broken line indication in FIG. 4) which fits snugly into slot 17**.

Constructed for use as a toilet trainer for children, the embodiment of FIGS. 1 and 2 is adapted to receive a saddle-simulating part 19 having a dependent receptacle or chamber pot portion 20. Body part 10 is formed with an upwardly-opening recess 21 into which receptacle 20 fits when the saddle part 19 is in place on the back of the body part, as in FIG. 1. Saddle part 19 may be provided with a saddle horn portion **19*a***, which serves as a deflector for the chamber pot.

If the device is to be used as an ornamental figure for holding flowers, a plant, or some other decorative item, the saddle part and receptacle may be separately formed, the receptacle having a rim for resting on the margins of the recess in the back of the body part so it can be used without the saddle part.

Figure 3:
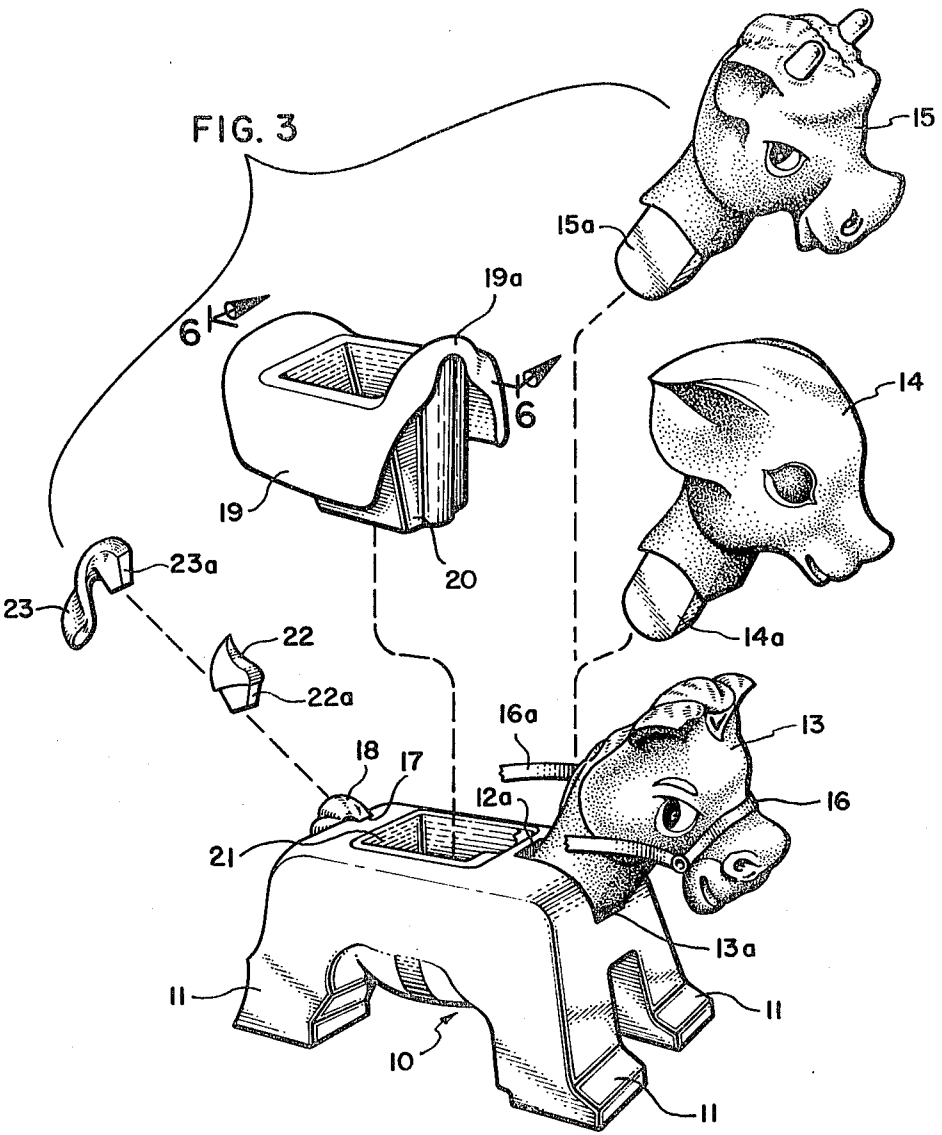

However used, alternate head parts, and tail parts corresponding thereto, are provided, as for example the head parts 14 and 15 and corresponding tail parts 22 and 23, respectively, of FIG. 3, so that the animal can be changed in character from time to time. Similarly to tail part 18, the tail parts 22 and 23 are provided with forwardly extending, flat tongues 22*a* and 23*a* as attachment means for fitting into receiving slot 17 of body part 10.

The several parts of the device of the invention may be made of various materials by fabrication techniques suitable for the particular materials employed.

Whereas the invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A riding animal device for children, comprising a body part adapted to be firmly supported on a receiving surface and having an outward configuration simulating the body portion of an animal, said body part being provided with a recessed surface defining a narrow, forwardly and upwardly open slot in the forward end thereof for removably receiving a head part, said slot being closed at its lower end; a plurality of independent head parts formed, respectively, to simulate the heads of different animals; correspondingly narrow, substantially flat tongues extending backwardly from the respective head parts for fitting snugly but freely into the said forwardly and upwardly open slot of the body part, the surface of said slot providing the sole support means for each of the tongues when inserted into said slot, each of said tongues when inserted into said slot forming the sole attachment means of the head part associated therewith to the body part to provide for quick and easy changing of the head parts; the opening of said forwardly and upwardly open slot in the body part extending rearwardly a distance such as to provide oscillating leeway for the received tongue of one of said head parts upwardly and rearwardly from the closed lower end thereof which serves as a limit stop for gravity descent of the head part; and bridle and reins associated with each of the head parts for enabling the head part associated with the tongue received in the slot as defined above to be pulled upwardly and rearwardly by a child seated on the animal.

2. A riding animal device for children in accordance with claim 1, wherein the body part is provided with an upwardly-open recess for receiving a receptacle; and there are provided a saddle part and a receptacle for removable placement on the body part, said receptacle being adapted to depend into the recess of the body part.

3. A riding animal device for children in accordance with claim 2, wherein the receptacle is formed as a depending portion of the saddle part, open thereinto, and is adapted to serve as a chamber pot for the toilet training of children.

4. A riding animal device for children according to claim 1, wherein the body part has a narrow, rearwardly open slot at its rear end for removably receiving a tail part; and wherein there are a plurality of independent tail parts formed, respectively, to simulate the tails of animals corresponding to those of the head parts; and correspondingly narrow, substantially flat tongues extending forwardly from the respective tail parts for fitting snugly into the said rearwardly open slot of the body part.

* * * * *